US006550469B2

(12) United States Patent
Hsu

(10) Patent No.: US 6,550,469 B2
(45) Date of Patent: Apr. 22, 2003

(54) IGNITION DEVICE FOR STOVE

(76) Inventor: Huang-Hsi Hsu, 8F, No. 14, Lane 252, Chungshan N. Rd., Sec. 6, Taipei (TW)

( * ) Notice: Subject to any disclaimer, the term of this patent is extended or adjusted under 35 U.S.C. 154(b) by 69 days.

(21) Appl. No.: 09/855,492

(22) Filed: May 16, 2001

(65) Prior Publication Data

US 2002/0148460 A1 Oct. 17, 2002

(30) Foreign Application Priority Data

Apr. 13, 2001 (TW) ..... 90205848 U

(51) Int. Cl.[7] ..... F24L 3/10; F23Q 3/00

(52) U.S. Cl. ..... 126/39 E; 431/264; 431/154; 361/253

(58) Field of Search ..... 126/39 E, 39 R, 126/39 BA, 9 A, 9 R; 431/264, 259, 255, 154; 361/253, 247; 362/205, 206

(56) References Cited

U.S. PATENT DOCUMENTS 2,129,239 A * 9/1938 Rook et al. ..... 431/262
3,387,555 A * 6/1968 Moran ..... 99/394
3,630,189 A * 12/1971 Hodges et al. ..... 126/41 R
3,742,839 A * 7/1973 Maley ..... 126/25 R
4,122,764 A * 10/1978 D'Ambra ..... 126/265
4,231,734 A * 11/1980 Burns ..... 431/274
4,302,181 A * 11/1981 Schlosser ..... 431/264
4,395,229 A * 7/1983 Yasuhira et al. ..... 431/261
4,756,336 A * 7/1988 Amezcua ..... 431/86
5,752,764 A * 5/1998 Shiau ..... 362/206

FOREIGN PATENT DOCUMENTS

JP 63-220018 A * 9/1988
JP 2001-12738 A * 1/2001

* cited by examiner

*Primary Examiner*—Henry Bennett
*Assistant Examiner*—Josiah Cocks
(74) *Attorney, Agent, or Firm*—Bacon & Thomas, PLLC

(57) ABSTRACT

An ignition device for stove comprises a battery container projected from a housing of the stove and having a battery therein, a releasable ignition switch projected from an outer end of the battery container and being capable of detaching therefrom for removing the battery from the battery container for replacement when the battery is used up, a high voltage generator within the stove being electrically coupled to the battery container through a first conductive line, and at least one second conductive line extended from the high voltage generator and having an arc tip proximal to a stove head of the stove. An electrical connection is established between the high voltage generator and the battery when the ignition switch is pressed for generating an arc in the art tip by the high voltage generator for igniting gas flowed from the stove head.

7 Claims, 4 Drawing Sheets

IGNITION DEVICE FOR STOVE

FIELD OF THE INVENTION

The present invention relates to stoves and more particularly to a battery operated ignition device for stove with improved characteristics.

BACKGROUND OF THE INVENTION

A conventional ignition device for stove 1 is shown in FIG. 1 comprising an ignition switch 11 provided on the housing of stove 1, a high voltage generator 13 within stove 1 being electrically coupled to ignition switch 11 through a conductive line, at least one second conductive line 15 (one is shown) extended from high voltage generator 13 and having an arc tip 151 near stove head 12 of stove 1, a battery 16 in high voltage generator 13, and a high voltage coil circuit 17 in high voltage generator 13. An electrical connection is established between battery 16 and high voltage coil circuit 17 when ignition switch 11 is pressed. Hence, an arc is generated in arc tip 151 of second conductive line 15 by the enabled high voltage coil circuit 17 for igniting gas flowed from stove head 12. However, the previous design suffered from a disadvantage. For example, when battery 16 is used up has to first detach housing of stove 1 and then detach housing of high voltage generator 13 prior to removing battery 16 for replacement. This is inconvenient. To the worse, it may be difficult to reassemble the stove 1 if one or more components (such as screw) are lost during above disassembly.

SUMMARY OF THE INVENTION

It is thus an object of the present invention to provide an ignition device for stove comprising a battery container projected from a housing of the stove and having a battery therein; a releasable ignition switch projected from an outer end of the battery container being capable of detaching the ignition switch for removing the battery from the battery container for replacement when the battery is used up; a high voltage generator within the stove being electrically coupled to the battery container through a first conductive line; and at least one second conductive line extended from the high voltage generator and having an arc tip proximal to a stove head of the stove; whereby an electrical connection is established between the high voltage generator and the battery when the ignition switch is pressed for generating an arc in the arc tip by the high voltage generator for igniting gas flowed from the stove head.

The above and other objects, features and advantages of the present invention will become apparent from the following detailed description taken with the accompanying drawings.

DETAILED DESCRIPTION OF THE PREFERRED EMBODIMENTS

Figure 1:
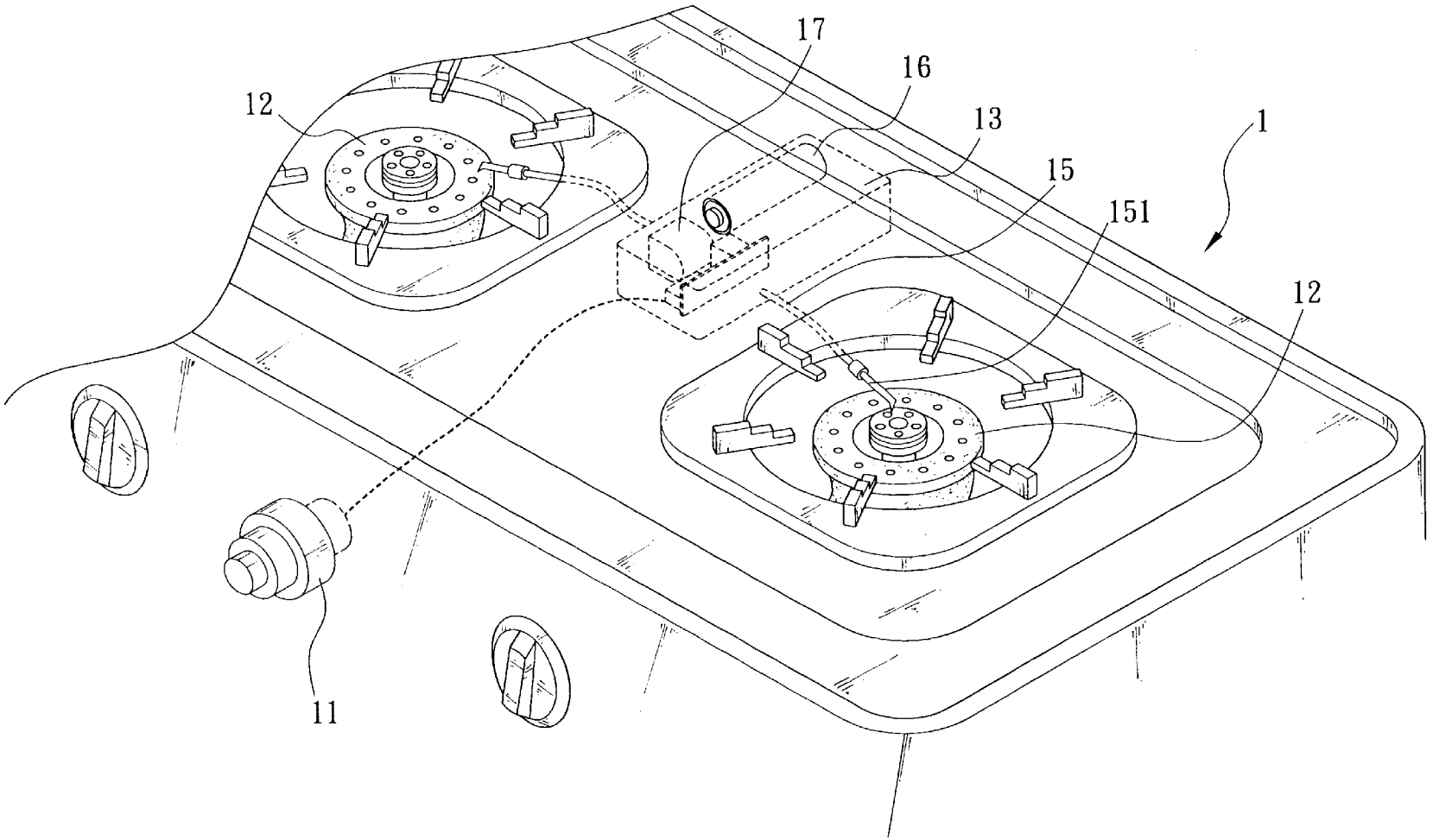
FIG. 1 (Prior Art)
FIG. 1 is a perspective view of a conventional ignition device mounted in a stove.
Figure 2:
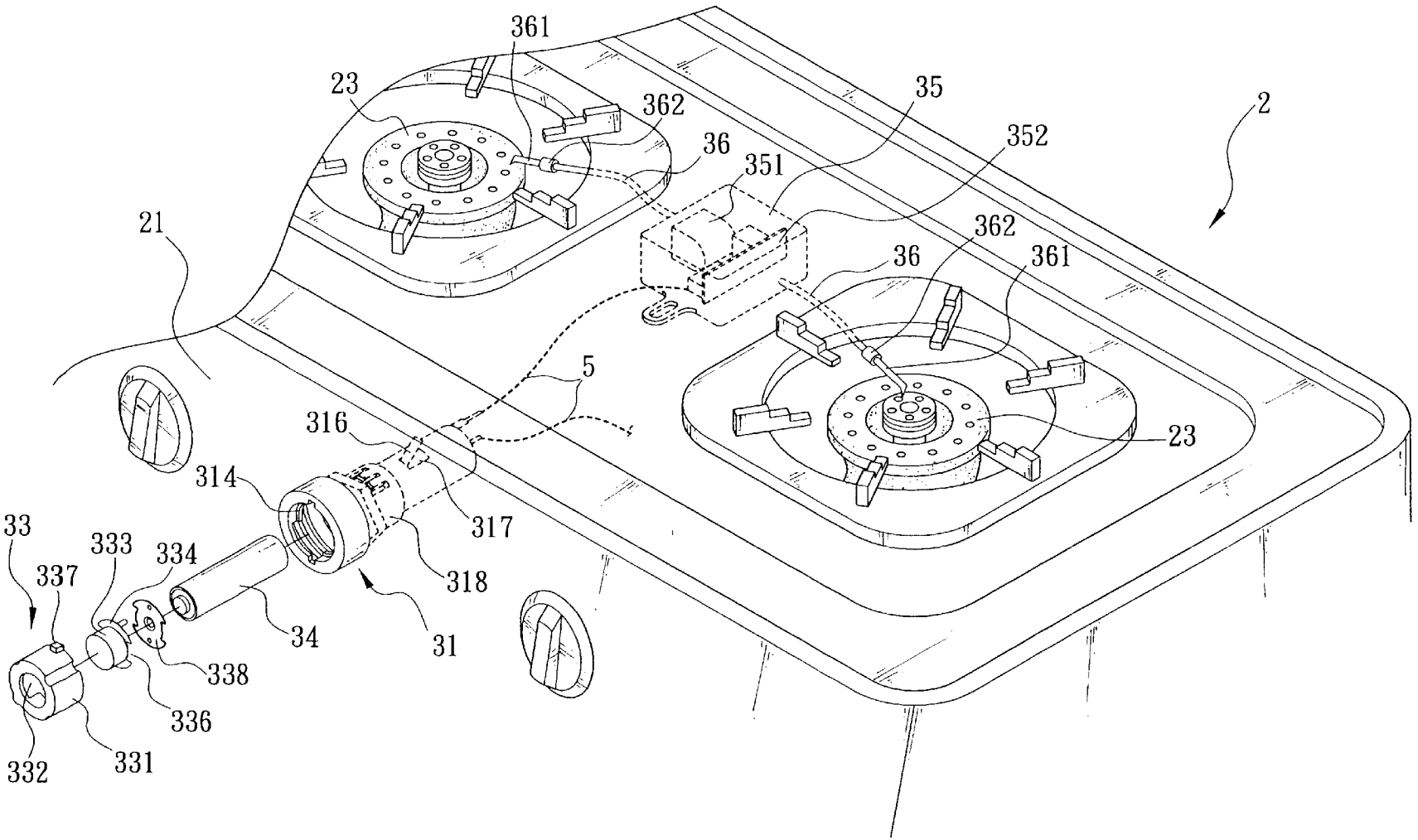
FIG. 2 is an exploded view of a first preferred embodiment of ignition device mounted in a stove according to the invention.
Figure 3:
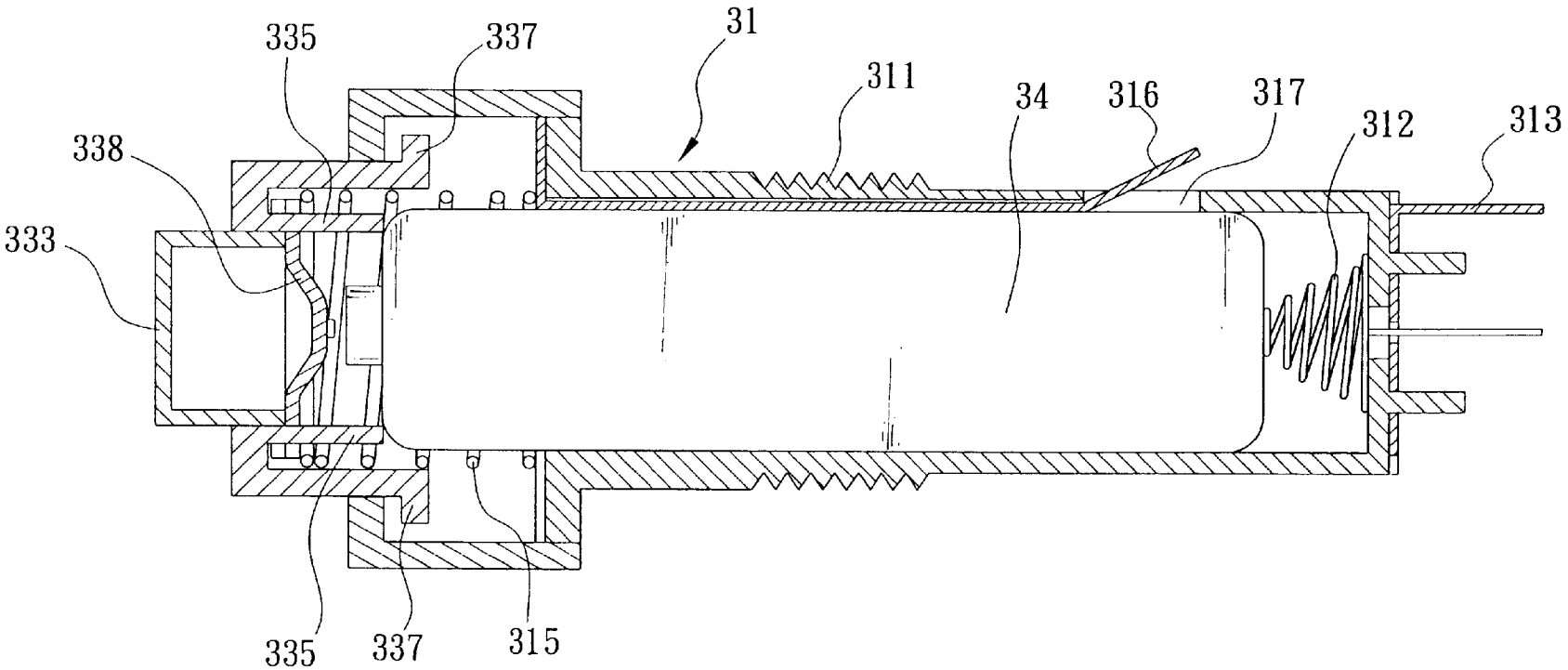
FIG. 3 is a sectional view of the FIG. 2 ignition device.

Referring to FIGS. 2 and 3, there is shown a first embodiment of ignition device for stove constructed in accordance with the invention. The ignition device comprises a battery container 31 projected from the housing 21 of stove 2, a releasable ignition switch 33 projected from the outer end of battery container 31, a battery 34 received in battery container 31, a high voltage generator 35 within stove 2 being electrically coupled to battery container 31 through a first conductive line 5, and at least one second conductive line 36 (one is shown) extended from high voltage generator 35 and having an arc tip 361 near stove head 23 of stove 2. An electrical connection is established between high voltage generator 35 and battery 34 when ignition switch 33 is pressed. Hence, an arc is generated in arc tip 361 of second conductive line 36 by the enabled high voltage generator 35 for igniting gas flowed from stove head 23. When battery 34 is used up, it merely need to detach ignition switch 33 in order to remove battery 34 from battery container 31 for replacement.

As shown, a threaded section 311 is formed on the surface of battery container. A hole 22 (see FIG. 4) is formed on the housing 21 of stove 2. A nut 318 within stove 2 is secured on the threaded section 311 (i.e., stove 2 and battery container 31 are secured together) when battery container 31 is inserted in hole 22 on housing 21 and clung therein. A first elastic member 312 is anchored in the bottom of battery container 31. In the embodiment, the first elastic member 312 is a helical spring while it is appreciated by those skilled in the art that first elastic member 312 may be replaced by another suitable element without departing from the scope and spirit of the invention. One end of first elastic member 312 contacts an electrode (i.e., cathode) of battery 34 and the other end passes through the inner end of battery container 31 to contact a metal member 313 which is in turn coupled to a ground terminal of stove 2 through first conductive line 5. Ignition switch 33 comprises a body 331, a lengthwise bore 332 in the body 331, a cylindrical trigger member 333, a flange 334 at the inner end of trigger member 333 and having an outer diameter larger than the diameter on the outer end of bore 332 so that an outer portion of trigger member 333 is projected from the outer end of body 331 while an inner portion thereof is received in body 331, two stop members 335 in body 331 disposed on opposite sides of trigger member 333, two recesses 336 on flange 334 matingly engaged with stop members 335 for limiting the movement of trigger member 333 to either the right or the left, and two opposite studs 337 projected on the outer surface near the inner end of body 331, two opposite grooves 314 on the inner surface of battery container 31 for receiving studs 337 by turning body 331 in one direction, thereby engaging ignition switch 33 with battery container 31. As to replace battery 34, user may disengage ignition switch 33 from battery container 31 by turning body 331 in a reverse direction. Ignition switch 33 further comprises a conductive piece 338 on the inner end of trigger member 333 and a second elastic member 315 having an outer end biased against the conductive piece 338 and an inner end biased against an inner shoulder of battery container 31. In the embodiment, the second elastic member 315 is a coil spring while it is appreciated by those skilled in the art that second elastic member 315 may be replaced by another suitable element without departing from the scope and spirit of the invention. Trigger member 333 is always urged to project from the bore 332 of body 331 by the expansion of second elastic member 315. A metal piece 316 is formed on the inner surface of battery container 31 being engaged with the inner end of second elastic member 315. Outer end of metal piece 316 passes through an opening 317 on the surface of battery container 31. Outer end of metal piece 316 is further coupled to high voltage generator 35 through first conductive line 5. Inner ends of stop members 335 are biased against the periphery on the other electrode (i.e., anode) of battery 34. This can prevent anode of battery 34 from contacting conductive piece 338 due to the expansion of first elastic member 312 in an unused position. In contrast, when user presses trigger member 333 of ignition switch 33 the conductive piece 338 will be pushed to contact the anode of battery 34. This establishes an electrical connection between battery 34 and high voltage generator 35. Hence, an arc is generated in arc tip 361 of second conductive line 36 by the enabled high voltage generator 35. Moreover, high voltage generator 35 comprises a high voltage coil 351 and a high voltage circuit 352 electrically coupled to second conductive line 36. Second conductive line 36 further has an insulated member 362 sleeved thereon near arc tip 361.

Figure 4:
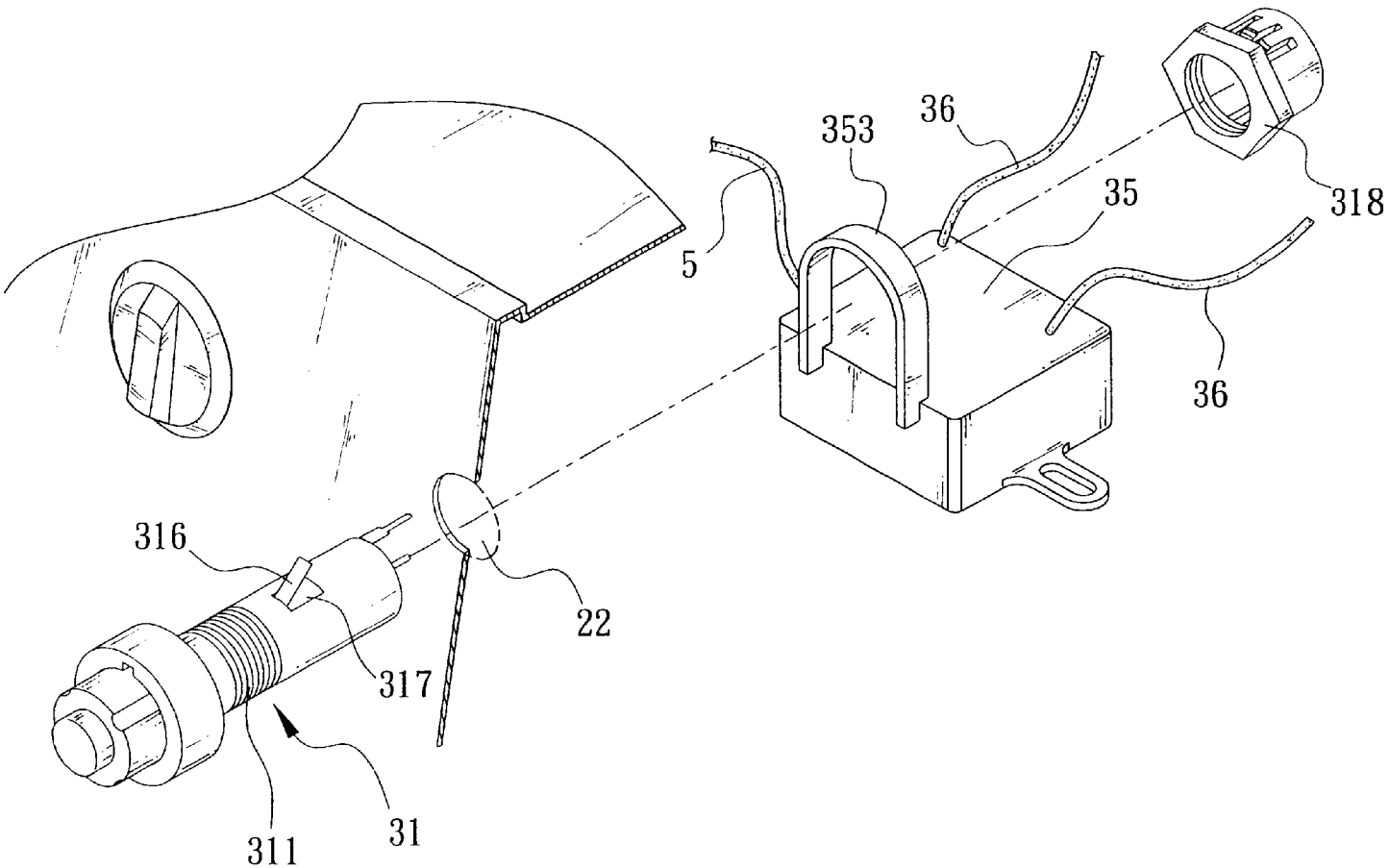
FIG. 4 is an exploded perspective view of a second preferred embodiment of ignition device mounted in a stove according to the invention.

Referring to FIG. 4, there is shown a second embodiment of ignition device. The difference between first and second embodiments is that an arch 353 is formed on one side of high voltage generator 35. Nut 318 is secured on the threaded section 311 (i.e., stove 2 and battery container 31 are secured together) when battery container 31 is inserted in hole 22 on housing 21 and clung therein. Arch 353 is clung on the nut 318. Further, arch 353 is secured to the inner side of housing 21 of stove 2. As an end, high voltage generator 35 is also secured to the inner side of housing 21 of stove 2.

The advantage of the invention is that when battery 34 is used up can easily detach ignition switch 33 in order to remove battery 34 from battery container 31 for replacement.

While the invention has been described by means of specific embodiments, numerous modifications and variations could be made thereto by those skilled in the art without departing from the scope and spirit of the invention set forth in the claims.

What is claimed is:

1. An ignition device for a stove comprising:

a) a battery container projected from a housing of said stove and having a battery therein;

b) a releasable ignition switch projected from an outer end of said battery container and being capable of detaching therefrom for removing said battery from said battery container and replacing said battery;

c) A high voltage generator within said stove being electrically coupled to said battery container through a first conductive line;

d) at least one second conductive line extended from said high voltage generator and having an arc tip proximal to a stove head of said stove;

e) a threaded section on an outer surface of said battery container, a hole on said housing of said stove, and a nut within said stove secured on said threaded section whereby said battery container is secured to said housing of said stove when said battery container is inserted in said hole and clung therein; and f) whereby an electrical connection is established between said high voltage generator and said battery when said ignition switch is pressed for generating an arc in said arc tip by said high voltage generator for igniting gas flowing from said stove head.

2. The ignition device of claim 1, further comprising a first elastic member in a bottom of said battery container having one end contacting a first electrode of said battery, and said other end passing through an aperture on said bottom of said battery container; and a metal member having one end coupled to said other end of said first elastic member and said other end coupled to a ground terminal of said stove through said first conductive line.

3. The ignition device of claim 2, wherein said ignition switch further comprises two opposite studs projected on said body proximal to an inner end thereof and two opposite grooves on an inner surface of said battery container for either receiving said studs by turning said body in a first direction so as to engage said ignition switch with said battery container or disengaging said ignition switch from said battery container by turning said body in a reverse second direction for replacing said battery.

4. The ignition device of claim 3, wherein said ignition switch further includes a conductive piece of said inner end of said trigger member, a second elastic member having an outer end biased against said conductive piece and an inner end biased against an inner portion of said battery container for urging said trigger member to project from said bore by expansion of said second elastic member.

5. The ignition device of claim 4, further comprising an opening on said outer surface of said battery container and a metal piece on said inner surface of said battery container being engaged with said inner end of said second elastic member and having an outer end passed through said opening for electrically coupling to said high voltage generator through said first conductive line whereby said electrical connection is established between said high voltage generator and said battery when said ignition switch is pressed to push said conductive piece to contact said second electrode of said battery for generating an arc in said arc tip by said high voltage generator.

6. The ignition device of claim 1, further including an arch formed on one side of said high voltage generator, the arch being clung on said nut and secured to an inner side of said housing of said stove whereby said high voltage generator is secured to said inner side of said housing of said stove when said battery container is inserted in said hole and clung therein.

7. An ignition device for a stove comprising:

a) a battery container projected from a housing of said stove and having a battery therein;

b) a releasable ignition switch projected from an outer end of said battery container and being capable of detaching therefrom for removing said battery from said battery container and replacing said battery, the ignition switch including a body, a lengthwise bore in said body, a trigger member, a flange at an inner end of said trigger member and having an outer diameter larger than a diameter on an outer end of said bore so that an outer portion of said trigger member is projected from an outer end of said body while an inner portion thereof is received in said body, two stop members in said body disposed on opposite sides of said trigger member and having inner ends biased against a periphery on a second electrode of said battery, and two recesses on said flange matingly engaged with said stop members for limiting a movement of said trigger member to either right or left;

c) a high voltage generator within said stove being electrically coupled to said battery container through a first conductive line;

d) at least one second conductive line extended from said high voltage generator and having an arc tip proximal to a stove head of said stove;

f) whereby an electrical connection is established between said high voltage generator and said battery when said ignition switch is pressed for generating an arc in said arc tip by said high voltage generator for igniting gas flowing from said stove head.

* * * * *